United States Patent [19]

Sutton

[11] 4,088,325

[45] May 9, 1978

[54] GOLF SWING TRAINING DEVICE

[76] Inventor: Otis Benjamin Sutton, 905 E. Maple St., North Canton, Ohio 44720

[21] Appl. No.: 747,691

[22] Filed: Dec. 6, 1976

[51] Int. Cl.[2] ..... A63B 69/36

[52] U.S. Cl. ..... 273/187 R; 273/195 B; 272/55

[58] Field of Search ..... 273/187 R, 187 B, 195 B, 273/183 A, 176 H; 272/1 R, 55 R, 70; 35/29 A

[56] References Cited

U.S. PATENT DOCUMENTS

| | | | |
|---|---|---|---|
| 2,941,801 | 6/1960 | Pedersen | 272/55 R X |
| 3,415,523 | 12/1968 | Boldt | 273/187 R X |
| 3,639,923 | 2/1972 | Stewart | 273/195 B X |
| 4,023,810 | 5/1977 | Lorang | 273/195 B X |

*Primary Examiner*—George J. Marlo

*Attorney, Agent, or Firm*—Frease & Bishop

[57] ABSTRACT

An instructional device to assist a golfer in developing a golf swing. A base member has one or more transversely extending projections mounted on its top surface, each of which has a rounded top edge to provide a pivot surface for a top board member. The top board is formed with a plurality of transversely extending grooves or a rounded projection on its bottom surface, operatively engageable with the base projections for pivotally or rockingly mounting the top board member on the base. A golfer assumes a usual golf stance on the top board. The weight shift of the golfer upon addressing a ball and during the backswing and downswing, causes the top board to pivot on the projections in a predetermined manner when done correctly to assist the golfer in perfecting the correct golf swing.

4 Claims, 12 Drawing Figures

GOLF SWING TRAINING DEVICE

BACKGROUND OF THE INVENTION

1. Field of the Invention

The invention relates to an instructional device for assisting a golfer in developing a correct golf swing. More particularly, the invention relates to a golf instructional device in which the golfer stands on a board which pivots between various predetermined positions in relation to the weight shift of a golfer during a golf swing.

2. Description of the Prior Art

Numerous devices have been developed and produced to assist a golfer in improving his or her golf game. Many of these devices are intended to be used or worn by the golfer during actual play to improve, control and develop a golf swing, which is one of the most important skills to be developed in becoming a better golfer. These known devices, many of which are beneficial to the golfer, are not permitted to be used or worn during tournament play under most professional and even amateur rules. This is a disadvantage to the golfer who has become dependent upon this device, and the golfer may revert to past bad habits when the device is no longer used or worn.

Many of these prior golf instructional devices or "aids" pertain to the correct positioning and gripping of the club by a golfer during a golf swing. Another of the important features in developing a golf swing is the correct shift of the golfer's weight at the proper time, before, during and after a golf swing.

No instructional device of which I am aware enables a golfer to develop correct body weight shift during a golf swing by having the golfer stand on a board which rocks between various positions and strikes a supporting base in relation to the golfer's weight shift during the golf swing.

SUMMARY OF THE INVENTION

Objectives of the invention include providing a golf instructional device adapted to be stood upon by a golfer and rock back and forth in direct relationship to the shift in the golfer's weight during a golf swing to assist the golfer in developing correct body movement during the golf swing; providing such a device having a base and a top board which is rockingly mounted on the base by rounded projections positioned between the base and board; providing such a device in which the front and rear edges of the top board alternately strike the base when the golfer's weight shifts during a golf swing enabling the golfer to determine when the weight shift occurs in relation to the position of the golf club during the swing; providing such a device which can be produced inexpensively of wood panels and wood dowel rods to provide a sturdy and durable construction, easily transported by a golfer to any desired location for use, and which is maintenance free; and providing such a golf instructional device which achieves the stated objectives in an extremely simple and economical manner, which is extremely simple in operation and use, which overcomes the disadvantages existing in the prior art.

These objectives and advantages are obtained by the golf instructional device of the invention, the general nature of which may be stated as including a generally planar base means having a top surface; rocking board means adapted to be stood upon by a golfer, said board means having generally planar top and bottom surfaces with said bottom surface being located in a spaced relationship above the top surface of the base means; projection means located between the base means and rocking board means and extending transversely with respect to said base and board means to space the rocking board means above the base means; and the projection means having a curved surface providing a transversely extending pivot surface about which the rocking board means pivots in one direction when a golfer enters the backswing and in another direction during the forward swing with the ends of the rocking board means alternately striking the base means to instruct a golfer in the correct golf swing body movement.

BRIEF DESCRIPTION OF THE DRAWINGS

Preferred embodiments of the invention — illustrative of the best modes in which applicant has contemplated applying the principle — are set forth in the following description and shown in the accompanying drawings, and are particularly and distinctly pointed out and set forth in the appended claims.

Similar numerals refer to similarparts throughout the drawings.

DESCRIPTION OF THE PREFERRED EMBODIMENTS

First Embodiment

Figure 1:
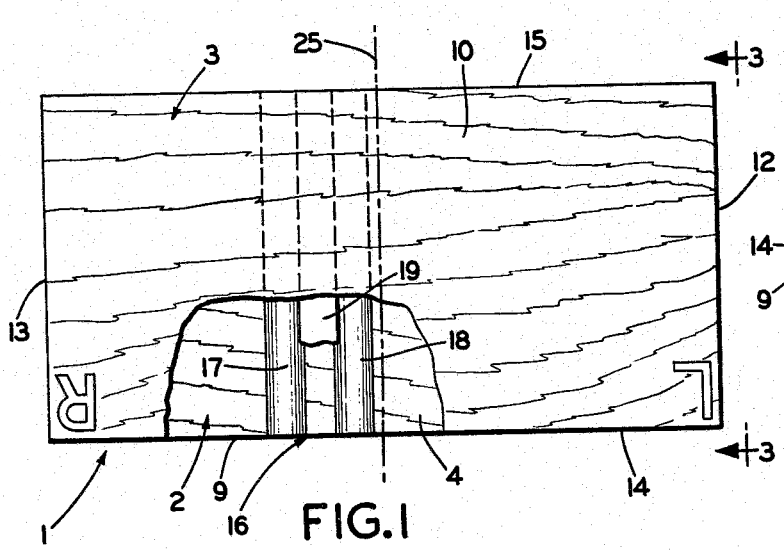
FIG. 1 is a top plan view with portions broken away, of one embodiment of the golf instructional device.
Figure 3:
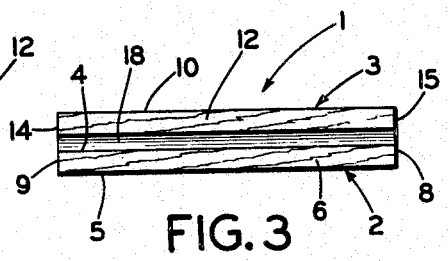
FIG. 3 is an end elevational view looking in the direction of arrows 3—3, FIG. 1.
Figure 2:
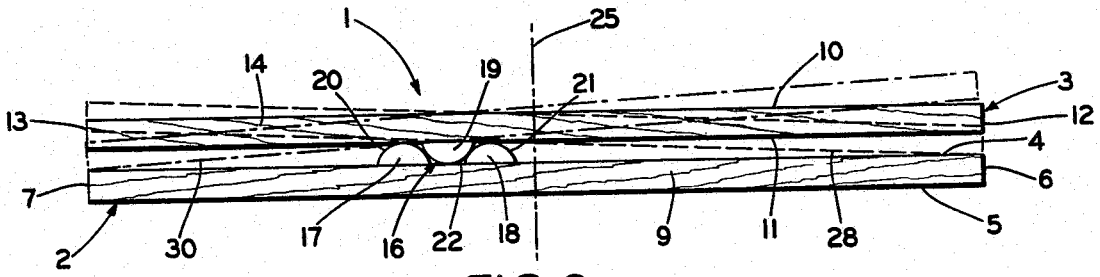
FIG. 2 is an enlarged front elevational view of the instructional device of FIG. 1, with an intermediate position being shown in full lines and end positions being shown in dotdash lines.

The preferred embodiment of the improved golf instructional device is indicated generally at 1, and is shown particularly in FIGS. 1, 2 and 3. Device 1 includes a base 2 and a top panel or board 3, referred to as a rocking board. Base 2 and board 3 preferably have rectangular configurations, as shown in the drawings and are of equal dimensions and formed of wood or plywood panels. Base 2 and board 3 (as an example) may have lengths of 24 inches, widths of 12 inches, and thicknesses of ¾ inches.

Base 2 includes a flat planar top surface 4, a similar parallel bottom surface 5, parallel end surfaces 6 and 7, and parallel side surfaces 8 and 9. Board 3 includes top and bottom spaced parallel planar surfaces 10 and 11, end surfaces 12 and 13, and side surfaces 14 and 15. End surfaces 6 and 12 are referred to as the forward ends of device 1 with end surfaces 7 and 13 being referred to as the rear ends of the device.

In accordance with one of the main features of the invention, projection means, indicated generally at 16, are mounted between base 2 and rocking board 3. Projection means 16 include a spaced pair of transversely extending semicylindrical members 17 and 18 and a third similar semicylindrical member 19. Members 17–19 preferably are formed from wood dowel rods which are halved along a longitudinally extending axis, whereby the outer surfaces 20,21 and 22, respectively, have semicircular cross-sectional configurations, as shown in FIG. 2.

Members 17–19 preferably extend transversely across the entire width of base 2 and board 3, whereby the crests of outer curved surfaces 20–22 form transversely extending pivot surfaces. Base members 17 and 18 are spaced sufficiently apart to enable board member 19 to be received therebetween, whereby the crest of curved surface 22 of member 19 engages top surface 4 of base 2 with the corresponding crests of surfaces 20–21 of members 17–18 engaging bottom surface 11 of board 3. Likewise, the inner sides of curved surfaces 20–21 engage the sides of curved surface 22 of member 19.

Members 17–19 are mounted rearwardly of the transverse center line 25 of base 2 and board 3, and are positioned so that end edges 6 and 12, and 7 and 13, respectively, are vertically aligned as shown in FIGS. 1 and 2. Projection members 17, 18 and 19 provide a pivotal or rocking mounting relationship of board 3 with respect to base 2. FIG. 2 shows the various end pivoted positions of board 3 with respect to base 2 in dot-dash lines, with the intermediate horizontal position being shown in full lines.

Figure 4:
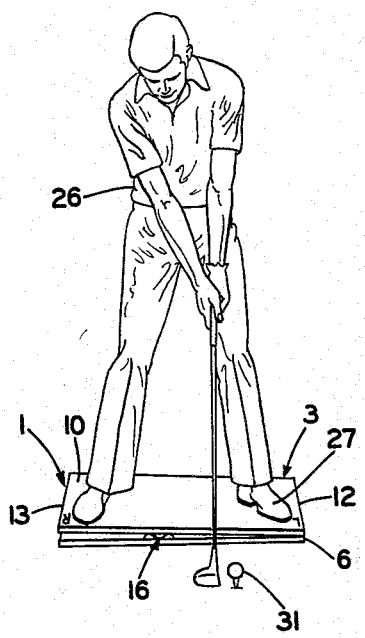
FIG. 4 is a diagrammatic perspective view of a golfer using the instructional device of FIGS. 1–3, shown in the ball address position.
Figure 5:
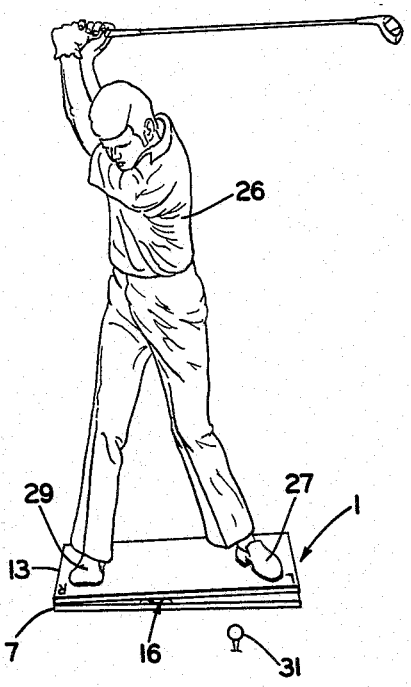
FIG. 5 is a view similar to FIG. 4, showing the golferin a full backswing position.
Figure 6:
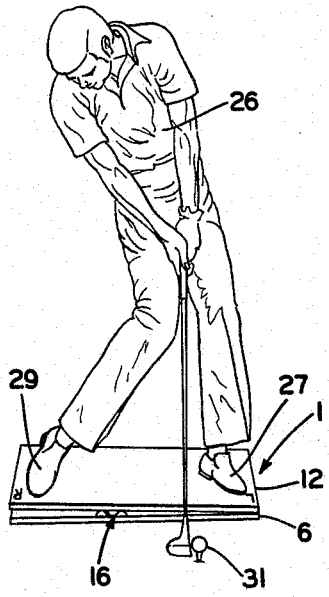
FIG. 6 is a view similar to FIGS. 4 and 5, showing the golfer in a ball striking position.

The operation and function of golf device 1 is shown diagrammatically in FIGS. 4, 5 and 6. A golfer 26 assumes a usual golf stance on top surface 10 of board 3, as shown in FIG. 4, with his left foot positioned generally adjacent forward end 12 and with his right foot placed generally adjacent rear end 13. Indicating letters "L" and "R" may be printed on top board surface 10 to insure the correct positioning of the golfer's feet so that projection means 16 is located rearwardly of the board and base center line 25 toward the right foot. It is readily understood that the above description is for a right-handed golfer and that the indicating letters and feet positions would be reversed for a left-handed golfer. FIG. 4 shows golfer 26 in a ball address position, in which position the weight on left foot 27 is approximately two thirds of the golfer's weight. This weight distribution causes board 3 to pivot downwardly forwardly to the dot-dash line position indicated at 28 (FIG. 2) and the position of FIG. 4, in which position front end 12 of board 3 strikes and contacts end 6 of base 2. This pivotal and striking movement informs the golfer that his weight distribution is correct at the ball address position.

The golfer then starts the backswing and his weight shifts from left foot 27 to right foot 29, causing board 3 to pivot from dot-dash position 28 to the parallel full line position of FIG. 2. As the golfer's weight shift continues to shift from his left to right foot, board 3 continues pivoting on projection means 16 until rear end 13 of board 3 strikes rear end 7 of base 2 (FIG. 5), and as dot-dash line position 30, FIG. 2. This movement and striking informs the golfer that the correct weight shift has occurred.

Golfer 26 then begins his downward forward swing with the weight shifting from the right to the left foot causing pivoting or rocking of board 3 from dot-dash line position 30 (FIG. 2) and the position of FIG. 5 to dot-dash line position 28 (FIG. 2) and FIG. 6, indicating to the golfer the correct time to swing through the ball with the club or reach the ball strike position of FIG. 6.

This rocking motion of board 3 caused by the shift of body weight (in combination with the location of the golf club) initially from the forward weight position (ball address position) of FIG. 4 into the backswing position of FIG. 5 and then forwardly into the ball strike position of FIG. 6, develops the correct body or swing rhythm and coordination of the golfer. When these movements are repeated a considerable number of times with or without an actual golf ball 31 being used, device 1 will train the golfer in the proper weight shift and club position for a correct golf swing.

SECOND EMBODIMENT

Figure 7:
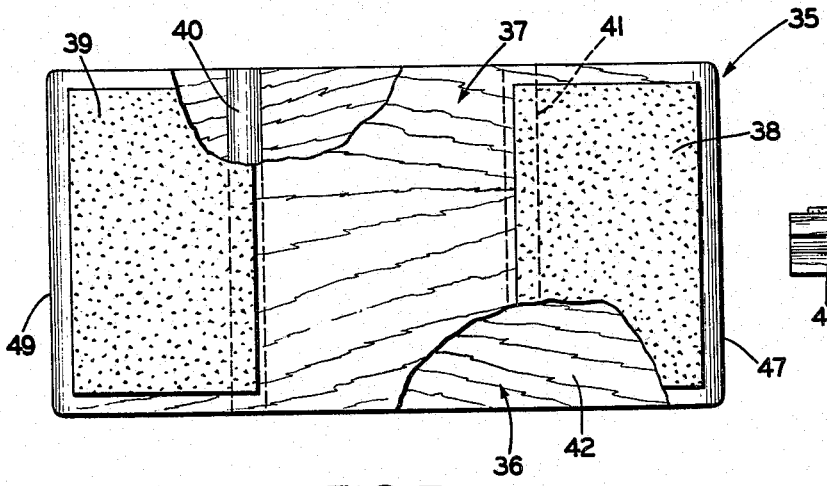
FIG. 7 is a top plan view with portions broken away, similar to FIG. 1, showing a modified form of the invention.
Figure 9:
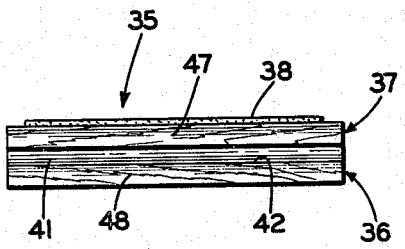
FIG. 9 is an end elevational view of the device of FIG. 7, similar to FIG. 3.
Figure 8:
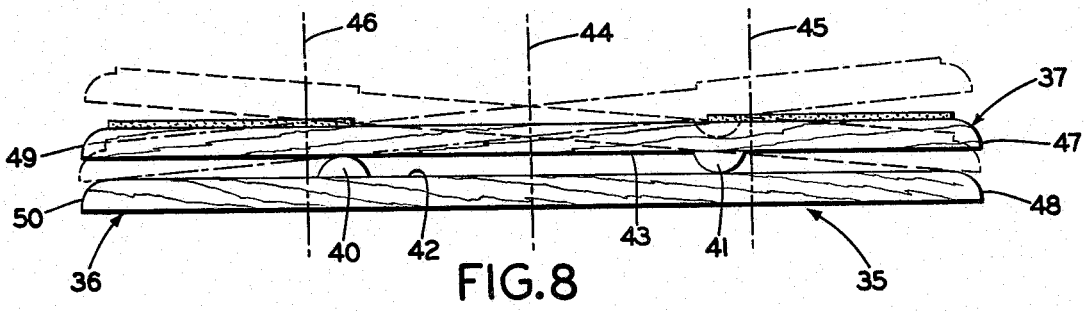
FIG. 8 is an enlarged front elevational view of the modified instructional device of FIG. 7 with the intermediate and end positions being shown in full and dotdash lines, respectively, similar to FIG. 2.

A modified form of the invention is shown in FIGS. 7, 8 and 9, and is indicated generally at 35. Device 35 is similar to device 1 in that it includes a base 36 and a top board 37. Base 36 and board 37 are generally similar in size and configuration to base 2 and board 3. Foot pads 38 and 39 may be mounted on the top surface of board 37 to provide feet position indicators and to increase the comfort of the golfer or to permit the golfer to wear spiked golf shoes without damaging the underlying board 37.

The projection means for device 35, which pivotally mounts and spaces top board 37 on and above base 36, includes a pair of spaced semicylindrical members 40 and 41. Members 40 and 41 are similar to members 17, 18 and 19 of device 1 and have a semicircular cross-sectional configuration (FIG. 8), preferably formed of wooden dowel rod halves.

Members 40 and 41 are mounted on top surface 42 of base 36 and on bottom surface 43 of board 37, respectively, and extend transversely across the width of base 36 and board 37. Member 41 is mounted forwardly of the transverse center line 44 with member 40 being mounted rearwardly of transverse center line 44. Likewise, members 40 and 41 are positioned slightly inwardly from the midpoints of imaginary transverse planes indicated by lines 45 and 46, of the forward and rear half sections of board 37.

The operation and function of device 35 is similar to that of device 1, except a stable intermediate position (full lines, FIG. 8) is provided which is not present in device 1. At the ball address position, the golfer's weight is on the left foot, causing top board 37 to pivot about member 41, causing front end 47 of board 37 to strike front end 48 of base 36, which tells the golfer the weight distribution is correct at the ball address position. Then the golfer starts his backswing and the weight shift to the right foot causes top board 37 to become parallel with base 36 being supported equally by projection members 40 and 41. Rear end 49 of top board 37 strikes rear end 50 of base 36 as the golfer's weight continues to shift from his front to rear foot during the backswing with top board 37 pivoting on projection member 40. The opposite pivoting or rocking action of board 37 takes place when the golfer swings the club from the backswing position of FIG. 5 to the ball strike position of FIG. 6.

THIRD EMBODIMENT

Figure 10:
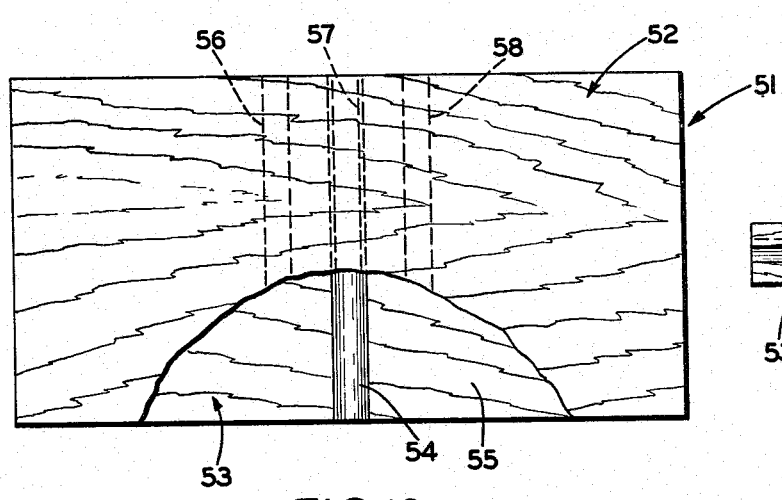
FIG. 10 is a top plan view with portions broken away, of a further modified golf instructional device similar to FIGS. 1 and 7.
Figure 12:
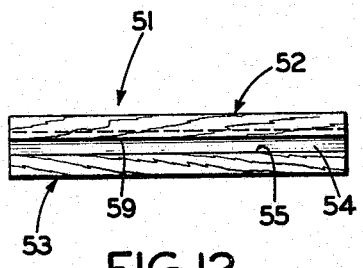
FIG. 12 is an end elevational view of the device shown in FIG. 10, similar to FIGS. 3 and9.
Figure 11:
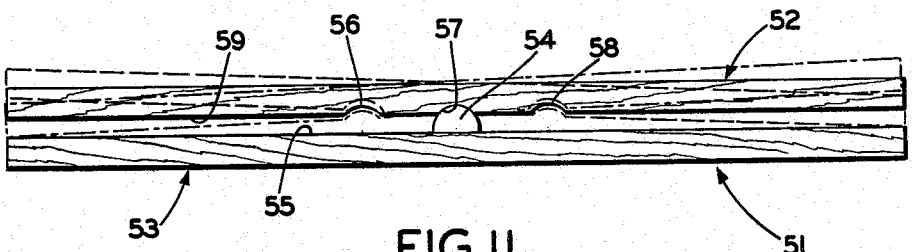
FIG. 11 is an enlarged front elevational view of the device shown in FIG. 10, with the various positions being shown in full and dot-dash lines, similar to FIGS. 2 and 8.

A further modified form of the invention is shown in FIGS. 10, 11 and 12 and is indicated generally at 51. Instructional device 51 includes a top board 52 and a base 53, similar to boards 3 and 37 and bases 2 and 36 of devices 1 and 35, respectively. One of the main modifications of this third embodiment is the projection means being a single semicylindrical member 54 mounted on top surface 55 of base 53 at the transverse center line thereof. Member 54 preferably extends transversely across the entire width of base 53. A plurality of transversely extending grooves 56, 57 and 58 is formed in the bottom surface 59 of top board 52 for selectively receiving projection member 54 therein to rockingly or pivotally mount top board 52 with respect to base 53 as in devices 1 and 35, discussed above.

The function and operation of device 51 is similar to that of devices 1 and 35, and therefore, is not described in detail. Another of the main features of modified device 51 is the adjustability of board 52 with respect to base 53 by engagement of projection 54 in centermost groove 57 or either end grooves 56 and 58.

SUMMARY

The various embodiments of the golf instructional device described above provides an extremely simple and rugged mechanism for instructing and training golfers to develop a correct golf swing by providing them with an indication when the body weight shift occurs with respect to the position of the golf club and to assist them in developing the correct swing rhythm. The golf instructional device enables this practice and training to be carried on either indoors or outdoors and does not require the use of an actual golf ball or simulated golf ball to achieve the advantages thereof.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the golf instructional device is constructed and used, the characteristics of the construction, and the advantageous, new and useful results obtained; the new and useful structures, devices, elements, arrangements, parts, and combinations, are set forth in the appended claims.

I claim:

1. A golf instructional device including:

(a) a generally flat rectangular-shaped base having a planar top surface;

(b) a pair of convexly-curved members attached to the top surface of the base and extending transversely across and upwardly from said base in a spaced parallel relationship;

(c) a generally flat rectangular-shaped rigid rocking board having planar top and bottom surfaces;

(d) a convexly-curved member fixed to the bottom surface of the rocking board and extending transversely across and downwardly from said bottom surface, said curved member being located off-center of the transverse centerline of said rocking board, and similar in size and configuration to the pair of convexly-curved members of the base; and (e) the curved member of the rocking board being located in the space between the curved members of the base and engageable with said base curved members to pivotally mount said rocking board on the base, whereby a golfer standing upon the rocking board pivots said platform in one direction when entering a backswing and in another direction during the forward swing.

2. The device defined in claim 1 in which the base and rocking board are of equal size and terminate in front and rear edges; in which the pair of base curved members are located off-center of the transverse centerline of the base; and in which the respective front and rear edges of the base and rocking board are in vertical alignment with each other and alternately strike each other during pivotal movement of the rocking board.

3. The device defined in claim 1 in which the rocking board and base are rectangular pieces of wood each having general dimensions of 24 inches in length, 12 inches in width, and $\frac{3}{4}$ inches in thickness.

4. The device defined in claim 1 in which the curved members are solid, semicylindrical members.

* * * * *